US011408663B2

(12) United States Patent
Cho et al.

(10) Patent No.: US 11,408,663 B2
(45) Date of Patent: Aug. 9, 2022

(54) EVAPORATOR AND REFRIGERATOR HAVING SAME

(71) Applicant: LG Electronics Inc., Seoul (KR)

(72) Inventors: Hyunwoo Cho, Seoul (KR); Woocheol Kang, Seoul (KR); Geunhyung Lee, Seoul (KR); Gwinan Hwang, Seoul (KR)

(73) Assignee: LG Electronics Inc., Seoul (KR)

( * ) Notice: Subject to any disclaimer, the term of this patent is extended or adjusted under 35 U.S.C. 154(b) by 92 days.

(21) Appl. No.: 16/086,724

(22) PCT Filed: Mar. 2, 2017

(86) PCT No.: PCT/KR2017/002268
§ 371 (c)(1),
(2) Date: Sep. 20, 2018

(87) PCT Pub. No.: WO2017/164532
PCT Pub. Date: Sep. 28, 2017

(65) Prior Publication Data

US 2019/0063818 A1 Feb. 28, 2019

(30) Foreign Application Priority Data

Mar. 22, 2016 (KR) ..... 10-2016-0034186

(51) Int. Cl.
*F25C 1/10* (2006.01)
*F25C 5/04* (2006.01)
(Continued)

(52) U.S. Cl.
CPC ..... *F25D 21/08* (2013.01); *F25B 39/02* (2013.01); *F25B 47/00* (2013.01); *F25B 47/006* (2013.01);
(Continued)

(58) Field of Classification Search
CPC ..... F25D 21/08; F25D 21/06; F25D 23/006; F25B 47/00; F25B 47/02; F25B 47/006; F25B 39/02; F25B 2347/00; H05B 3/56
(Continued)

(56) References Cited

U.S. PATENT DOCUMENTS 1,975,659 A * 10/1934 Money ..... F25B 39/024 62/523
2,143,976 A * 1/1939 Crosley ..... F25B 39/024 165/170
(Continued)

FOREIGN PATENT DOCUMENTS

KR 19970044632 7/1997
KR 2019990020195 11/1997
(Continued)

OTHER PUBLICATIONS

International Search Report in International Application No. PCT/KR2017/002268, dated Jun. 1, 2017, 4 pages.
(Continued)

*Primary Examiner* — Eric S Ruppert
*Assistant Examiner* — Kirstin U Oswald
(74) *Attorney, Agent, or Firm* — Fish & Richardson P.C.

(57) ABSTRACT

An evaporator includes: an evaporator case that defines a food storage space therein; a cooling tube located at the evaporator case and filled with refrigerant; a foil heater attached to at least one surface of the evaporator case and configured to contact the evaporator case and to generate heat such that heat for defrosting is transferred to the evaporator case. A defrosting time is reduced in comparison to that of conventional natural defrosting, such that the freshness of food can be maintained, and the cooling efficiency, having been reduced by frost, is increased such that power consumption can be reduced. The foil heater is
(Continued)

attached to a conventional roll-bond type evaporator case, and the present invention has an advantageous effect of facilitating the maintenance of the foil heater because of a structure in which the foil heater is attached to the evaporator case.

18 Claims, 6 Drawing Sheets

(51) Int. Cl.

| | |
|---|---|
| ***F25D 21/08*** | (2006.01) |
| ***F25B 39/02*** | (2006.01) |
| ***F25D 21/06*** | (2006.01) |
| ***F25B 47/00*** | (2006.01) |
| ***F25B 47/02*** | (2006.01) |
| ***H05B 3/56*** | (2006.01) |
| ***F25D 23/00*** | (2006.01) |

(52) U.S. Cl.
CPC ..... *F25B 47/02* (2013.01); *F25D 21/06* (2013.01); *F25D 23/006* (2013.01); *H05B 3/56* (2013.01); *F25B 2347/00* (2013.01)

(58) Field of Classification Search
USPC ..... 62/275; 219/202, 208
See application file for complete search history.

(56) References Cited

U.S. PATENT DOCUMENTS 2,579,964 A * 12/1951 Reynolds ..... H05B 3/342 392/435
2,601,466 A * 6/1952 Thomas ..... F25D 21/002 62/275
2,685,634 A * 8/1954 Sterling ..... F25D 21/08 338/226
2,737,785 A * 3/1956 Morton ..... F25B 39/024 62/277
2,867,093 A * 1/1959 Simmons ..... F25D 21/08 62/158
2,920,377 A * 1/1960 Janos ..... F25B 39/024 29/613
2,936,598 A * 5/1960 Gould ..... F25B 39/00 29/890.035
3,380,867 A * 4/1968 Morey ..... H05B 3/565 156/437
4,347,433 A * 8/1982 Wojtecki ..... F16L 53/32 219/535

FOREIGN PATENT DOCUMENTS

| | | |
|---|---|---|
| KR | 19980023083 | 7/1998 |
| KR | 19990017199 | 5/1999 |
| KR | 200170050 | 3/2000 |
| KR | 100246378 | 4/2000 |
| KR | 200322790 | 8/2003 |
| KR | 1020030088657 | 11/2003 |
| KR | 20050026246 | 3/2005 |

OTHER PUBLICATIONS

Supplementary European Search Report in European Application No. 17770503.5, dated Oct. 25, 2019, 8 pages.
Office Action in Korean Appln. No. 10-2016-0034186, dated May 20, 2022, 17 pages (with English translation).

* cited by examiner

EVAPORATOR AND REFRIGERATOR HAVING SAME

CROSS-REFERENCE TO RELATED APPLICATIONS

This application is a National Stage application under 35 U.S.C. § 371 of International Application No. PCT/KR2017/002268, filed on Mar. 2, 2017, which claims the benefit of Korean Application No. 10-2016-0034186, filed on Mar. 22, 2016. The disclosures of the prior applications are incorporated by reference in their entirety.

BACKGROUND OF THE INVENTION

1. Field of the Invention

The present disclosure relates to an evaporator having a defrosting device for removing frost, and a refrigerator having the same.

2. Description of the Related Art

The refrigerator is a device for keeping food stored in the refrigerator at low temperatures using cold air generated by a refrigerating cycle in which a process of compression, condensation, expansion, and evaporation is continuously performed.

A refrigerating cycle in a refrigerating chamber (or refrigerating compartment) includes a compressor compressing a refrigerant, a condenser condensing the refrigerant in a high-temperature and high-pressure state compressed by the compressor through heat dissipation, and an evaporator cooling ambient air according to a cooling operation of absorbing ambient latent heat as the refrigerant provided from the condenser is evaporated. A capillary or an expansion valve is provided between the condenser and the evaporator to increase a flow rate of the refrigerant and lower pressure so that the refrigerant flowing to the evaporator may easily be evaporated.

A cooling method of the refrigerator may be divided into an indirect cooling method and a direct cooling method.

The indirect cooling method is a method of cooling the inside of a storage chamber by forcibly circulating cold air generated by the evaporator using a blow fan. Generally, the indirect cooling method is applied to a structure in which a cooler chamber in which an evaporator is installed and a storage chamber in which food is stored are separated from each other.

The direct cooling method is a method in which the inside of a storage chamber is cooled by natural convection of cold air generated by an evaporator. The direct cooling method is largely applied to a structure in which an evaporator is formed in an empty box form to form a storage chamber in which food is stored.

Generally, a direct cooling type refrigerator employs a roll-bond type evaporator in which two case sheets with a pattern part interposed therebetween are pressure-welded, high pressure air is blown into the compressed pattern part to discharge the pattern part, and a portion where the pattern part was present is expanded to form a cooling channel in which a refrigerant flows between the two pressure-welded case sheets.

Meanwhile, a difference in relative humidity between a surface of the evaporator and ambient air may cause moisture to be condensed to develop to frost on the surface of the evaporator. The frost deposited on the surface of the evaporator acts as a factor to degrade heat exchange efficiency of the evaporator.

In the case of an indirect cooling type refrigerator, a defrost heater is installed in an evaporator to remove frost deposited on the evaporator. The defrost heater is driven (turned on/off) according to predetermined conditions to generate heat to melt and remove frost deposited on the evaporator.

However, a direct cooling type refrigerator having the structure in which a defrost heater is applied to an evaporator has not yet been proposed. Therefore, in the case of the direct cooling type refrigerator, in order to remove frost, natural defrosting must be performed for a predetermined period of time after forcibly turning off a compressor, causing inconvenience, and it is difficult to ensure freshness of food due to the long defrosting time.

SUMMARY OF THE INVENTION

A first object of the detailed description is to provide an evaporator having a new structure in which a foil heater is applied to a roll-bond type evaporator case applied to a direct cooling type refrigerator.

A second object of the detailed description is to provide an evaporator having a foil heater which may use an existing roll-bond type evaporator case as is and which facilitates maintenance.

A third object of the detailed description is to provide a structure capable of solving a problem that, in a structure in which a foil heater is adhered to an evaporator case, when frost is deposited on the foil heater, the foil heater is separated from the evaporator case due to the weight of frost to affect defrosting reliability.

In order to achieve the first object, an evaporator includes an evaporator case having an empty box shape in which both sides are open and forming a storage space for food therein; a cooling tube formed in a predetermined pattern on the evaporator case and filled with a refrigerant for cooling; and a foil heater attached to be in surface-contact with at least one surface of the evaporator case and generating heat when power is applied thereto such that heat for defrosting is transferred to the evaporator case.

The second object may be achieved by attaching a foil heater to an existing roll-bond type evaporator case having a cooling flow channel embedded therein.

The third object may be achieved by a release preventing member or a fixing member.

The release preventing member may be installed on the evaporator case to cover an outer side of the foil heater to prevent release of the foil heater. The release preventing member may be provided on a lower surface portion of the evaporator case.

For example, the release preventing member may include first and second protrusions respectively protruding from both sides of the foil heater; and a connection portion connecting the first and second protrusions to cover an outer side of the foil heater.

In another example, the release preventing member may include: a protrusion protruding from one side of the foil heater; and an extending portion bent from the protrusion and extending to cover an outer side of the foil heater.

The fixing member is wound on an outer side of the evaporator case through a hole formed in the evaporator case and a through hole formed in the foil heater so as to be bound, thus fixing the foil heater to the evaporator case.

The aforementioned evaporator may be configured as follows.

The foil heater may be attached to an outer surface of the evaporator case.

The evaporator case may be formed by bending two coupled case sheets to have a quadrangular box shape in which a lower surface portion, side surface portions, and an upper surface portion are provided and both sides thereof are open, and the foil heater may be attached to be in surface-contact with at least a portion of each of the lower surface portion, the side surface portions, and the upper surface portion to surround the evaporator case.

The foil heater may extend along the edges of the two coupled case sheets to surround the cooling tube.

The foil heater may be disposed not to overlap the cooling tube.

The foil heater may include: a foil portion in which two facing sheets are attached to each other; an electric heating wire interposed between the two facing sheets of the foil portion and generating heat when power is applied thereto; and a thermally conductive adhesive provided on one surface of the foil portion to adhere the foil portion to at least one surface of the evaporator case.

The foil heater may further include: a lead wire connected to the electric heating wire and extending to the outside of the foil portion, and the lead wire exposed to the outside of the foil portion may be covered with a protective tube.

The evaporator may further include: a cover member disposed to cover the end of the foil portion to prevent penetration of moisture to the end of the foil portion from which the lead wire extends.

The effects of the present disclosure obtained through the above-mentioned solution are as follows.

First, the foil heater is attached to be in surface-contact with at least one surface of the evaporator case and is driven (turned on/off) according to predetermined conditions to generate heat. Heat generated by the foil heater is transferred to the evaporator case to melt frost deposited on the evaporator case. In this manner, according to the present disclosure, since a defrost time is reduced compared with the existing natural defrosting, freshness of food may be maintained and cooling efficiency, which is reduced due to frost, may be increased to reduce power consumption.

Second, the structure of the present disclosure may be realized by attaching the foil heater to an existing roll-bond type evaporator case. Further, in terms of the structure in which the foil heater is attached to the evaporator case, maintenance of the foil heater is facilitated.

Third, when the foil heater is separated from the evaporator case, the foil heater is maintained in a state of being positioned to be adjacent to the evaporator case by the release preventing member or the fixing member, rather than being completely separated, and thus, a problem related to defrosting reliability due to separation of the foil heater may be solved.

DETAILED DESCRIPTION OF THE INVENTION

Figure 1:
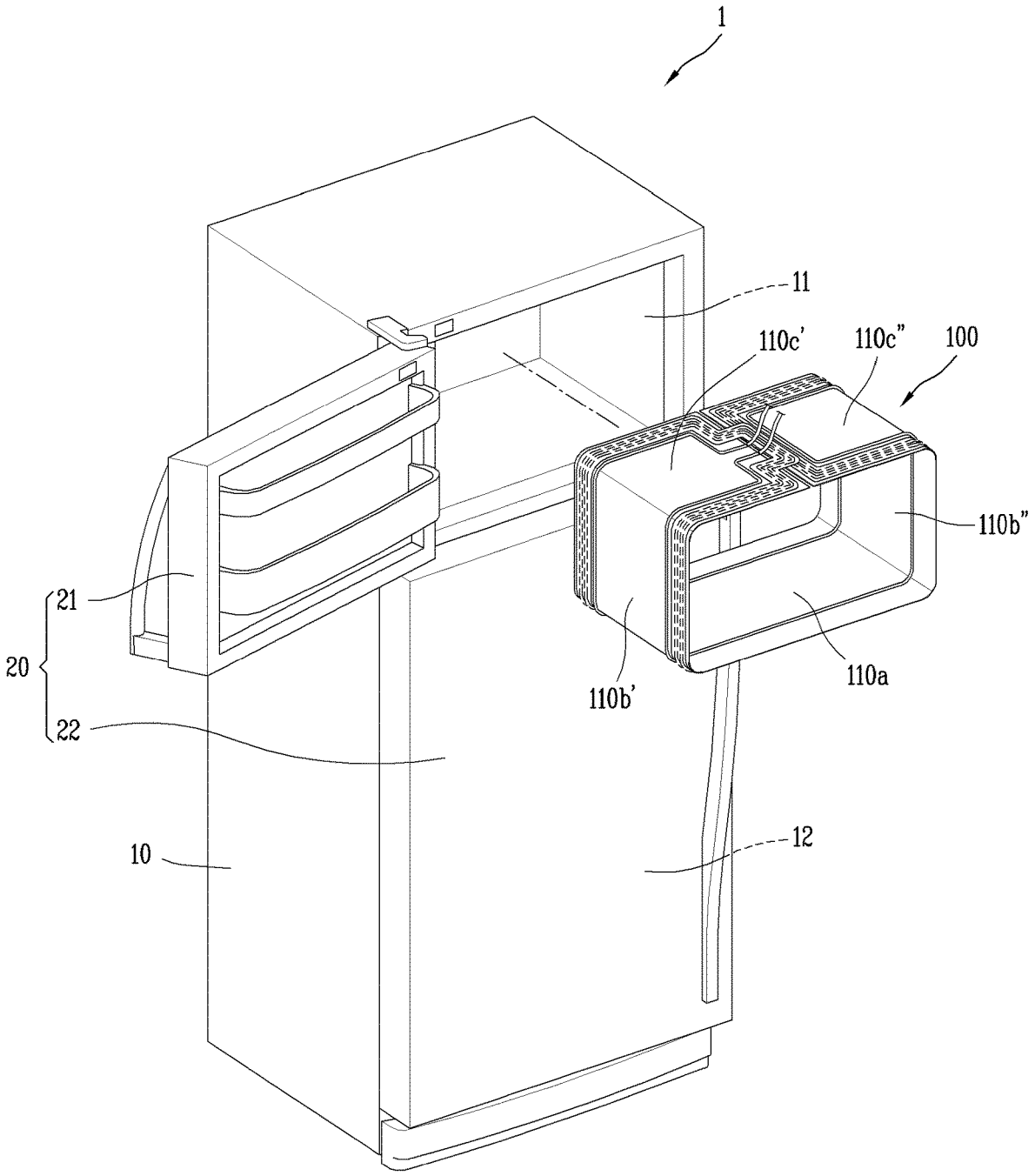
FIG. 1 is a conceptual view illustrating a refrigerator according to an embodiment of the present disclosure.

Hereinafter, an evaporator and a refrigerator having the evaporator according to the present disclosure will be described in detail with reference to the accompanying drawings.

In the present disclosure, the same reference numerals are given to the same or similar components in the different embodiments, and a redundant description thereof will be omitted.

In addition, the structure applied to any one embodiment may be applied in the same manner to another embodiment as long as the different embodiments are not structurally and functionally inconsistent.

As used herein, the singular forms "a", "an" and "the" are intended to include the plural forms as well, unless the context clearly indicates otherwise.

In the following description, when the detailed description of the relevant known function or configuration is determined to unnecessarily obscure the important point of the present disclosure, the detailed description will be omitted.

The accompanying drawings of the present disclosure aim to facilitate understanding of the present disclosure and should not be construed as limited to the accompanying drawings. Also, the present disclosure is not limited to a specific disclosed form, but includes all modifications, equivalents, and substitutions without departing from the scope and spirit of the present disclosure.

FIG. 1 is a conceptual view illustrating a refrigerator 1 according to an embodiment of the present disclosure.

The refrigerator 1 is a device for keeping food stored therein at low temperatures using cold air generated by a refrigerating cycle in which a process of compression, condensation, expansion, and evaporation is continuously performed.

As illustrated, a cabinet 10 has a storage space for storing food therein. The storage space may be separated by a partition wall and may be divided into a freezing chamber (or a freezing compartment) 11 and a refrigerating chamber (or a refrigerating compartment) 12 according to set temperatures.

In the present embodiment, a top mount type refrigerator in which the freezing chamber 11 is disposed on the refrigerating chamber 12 is illustrated, but the present disclosure is not limited thereto. The present disclosure is also applicable to a side-by-side type refrigerator in which a freezing chamber and a refrigerating chamber are disposed on the left and right, and a bottom freezer type refrigerator in which a refrigerating chamber is provided at an upper portion thereof and a freezing chamber is provided at a lower portion thereof.

A door 20 is connected to the cabinet 10 to open and close a front opening of the cabinet 10. In the figure, a freezing chamber door 21 and a refrigerating chamber door 22 are configured to open and close the front openings of the freezing chamber 11 and the refrigerating chamber 12, respectively. The door 20 may be variously configured as a rotatable door rotatably connected to the cabinet 10, a drawer-type door slidably connected to the cabinet 10, and the like.

A machine chamber (not shown) is provided in the cabinet 10, and a compressor, a condenser, and the like, are provided in the machine chamber. The compressor and the condenser are connected to the evaporator 100 to constitute a refrigerating cycle.

Meanwhile, a refrigerant R circulating in the refrigerating cycle absorbs ambient heat in the evaporator 100 as evaporation heat, thereby obtaining a cooling effect in the periphery. In this process, when a temperature difference with ambient air occurs, moisture in the air is condensed and frozen on the surface of the evaporator 100, that is, frost is deposited thereon. Frost deposited on the surface of the evaporator 100 acts as a factor to lower the heat exchange efficiency of the evaporator 100.

In the case of an indirect cooling type refrigerator, a structure in which a defrost heater is installed in an evaporator to remove frost deposited on the evaporator has already been well known. However, in the case of the direct cooling type refrigerator 1 as illustrated in the illustrated embodiment, the structure in which a defrost heater is applied to the evaporator 100 has not yet been proposed.

Thus, a new type evaporator 100 employing a defrost heater to reduce power consumption during defrosting in the direct cooling type refrigerator 1 according to the present disclosure will be described.

Figure 2:
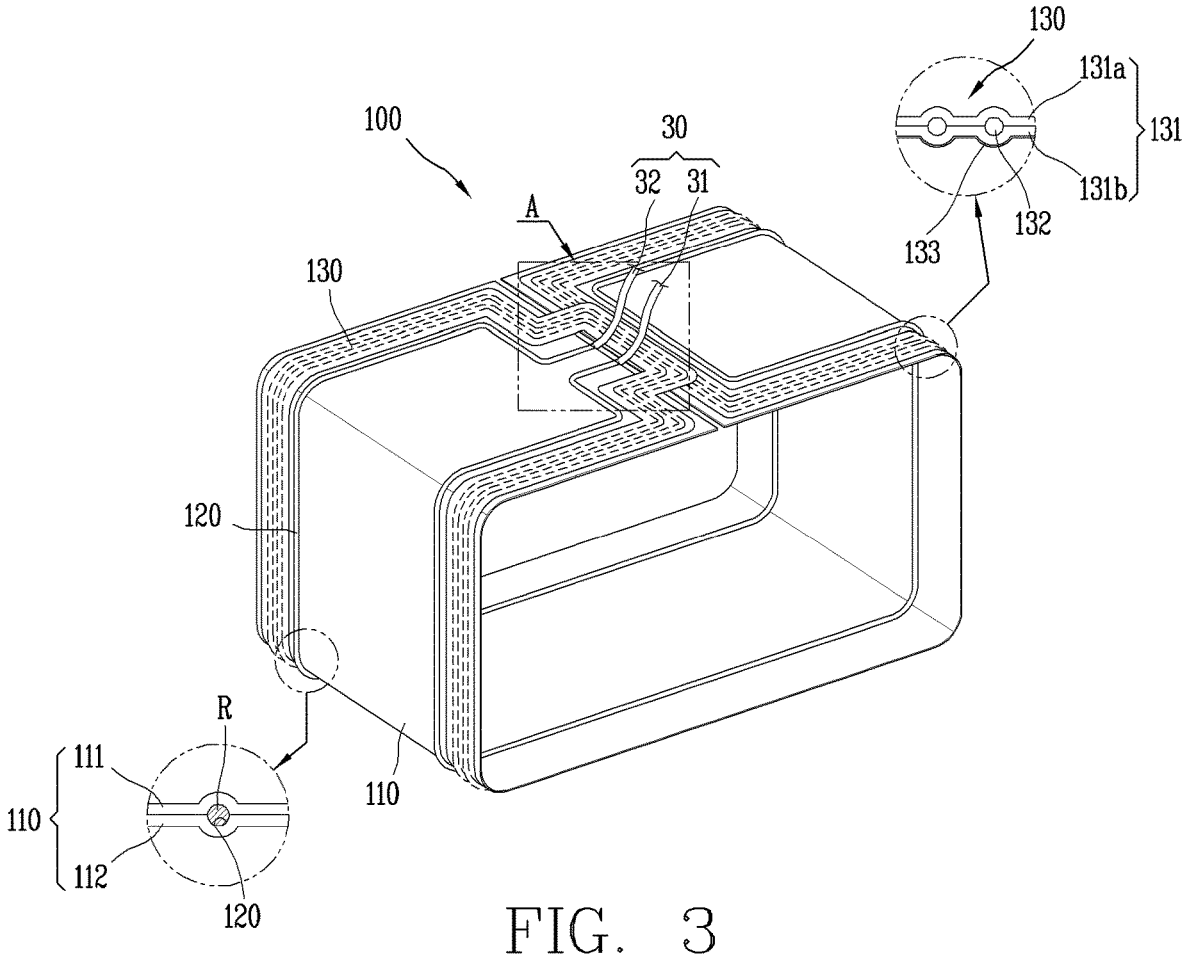
FIGS. 2 and 3 are conceptual views of a first embodiment of an evaporator applied to the refrigerator of FIG. 1, viewed from different directions.
Figure 3:
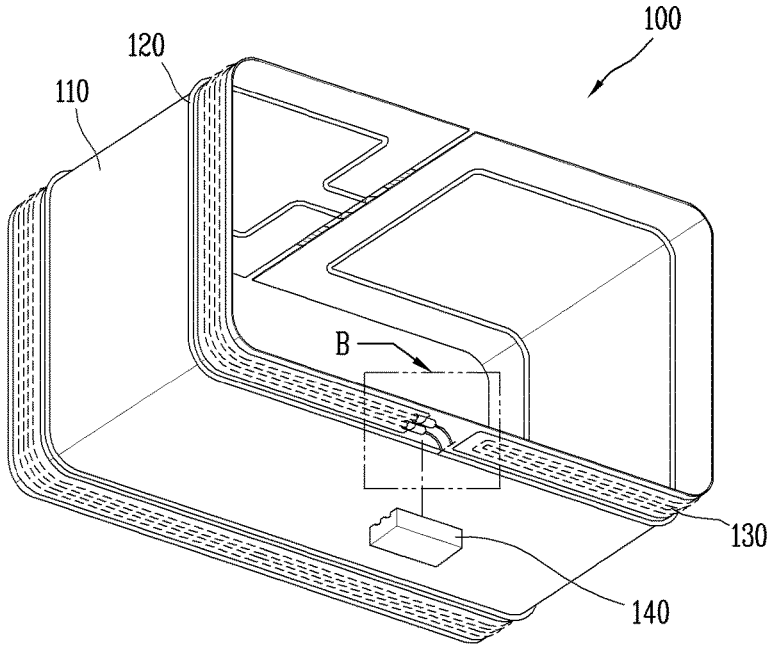

FIGS. 2 and 3 are conceptual views illustrating a first embodiment of the evaporator 100 applied to the refrigerator 1 of FIG. 1, which are viewed in different directions.

Referring to FIGS. 2 and 3, the evaporator 100 of the present disclosure includes an evaporator case 110, a cooling tube 120, and a foil heater 130. Among the components of the evaporator 100, the cooling tube 120 is a component for cooling, and the foil heater 130 is a component for defrosting. For reference, the cooling tube 120 and the foil heater 130 are illustrated briefly for convenience of explanation, and in actuality, these components may have various forms.

The evaporator case 110 is formed in an empty box shape and forms a storage space for food therein. The evaporator case 110 itself may form the storage space for food therein or may be configured to enclose a housing (not shown) separately provided to form a storage space for food.

The cooling tube 120 through which a refrigerant R for cooling flows is formed in the evaporator case 110. The cooling tube 120 is embedded in at least one surface of the evaporator case 110 to form a cooling flow channel through which the refrigerant R may flow.

A method of manufacturing the evaporator case 110 in which the cooling tube 120 is formed will now be described.

First, a first case sheet 111 and a second case sheet 112, which are materials of the evaporator case 110, are prepared. The first and second case sheets 111 and 112 may be formed of a metal (e.g., aluminum, steel, etc.) and a coating layer may be formed on the surfaces of the first and second case sheets 111 and 112 to prevent corrosion due to contact with moisture.

Thereafter, a pattern portion corresponding to the cooling tube 120 is disposed on the first case sheet 111. The pattern portion, which is to be removed later, may be a graphite material disposed in a predetermined pattern.

The pattern portion may be formed so as to continuously extend without a broken portion and may be bent in at least at one portion. The pattern portion may extend from a first corner of the first case sheet 111 to a second corner. The first corner at which the pattern portion starts and the second corner at which the pattern portion terminates may be the same corner or may be different corners.

Next, the first and second case sheets 111 and 112 are brought into contact with each other with the pattern portion interposed therebetween, and then the first and second case sheets 111 and 112 are compressed using a roller device so as to be integrated.

Then, a frame having a plate shape in which the first and second case sheets 111 and 112 are integrated is formed, and the pattern portion is located in the plate-shaped frame. In this state, high-pressure air is injected into the pattern portion exposed to the outside through one side of the frame corresponding to the first corner.

The pattern portion existing between the first and second case sheets 111 and 112 is discharged from the frame by the jetted high-pressure air. In this process, the space in which the pattern unit was present is left as an empty space to form the cooling tube 120.

In the process of discharging the pattern portion by injecting the high-pressure air, the portion where the pattern portion was present may expand, relative to the volume of the pattern portion, to form a cooling flow channel allowing the refrigerant R to flow therein.

According to the manufacturing method, a cooling tube 120 protruding from at least one surface is formed on the frame. For example, when the first and second case sheets 111 and 112 have the same rigidity, the cooling tube 120 protrudes from both sides of the frame. In another example, when the first case sheet 111 has a higher rigidity than the second case sheet 112, the cooling tube 120 protrudes from the second case sheet 112 having a relatively low rigidity and the first case sheet 111 having a relatively high rigidity is kept flat.

The integrated plate-shaped frame is bent to form the evaporator case 110 in the form of an empty box as illustrated. For example, referring to FIG. 1 together, the evaporator case 110 may have a lower surface portion 110*a*, a left side surface portion 110*b*' and a right side surface portion 110*b*" extending to opposing sides from the lower surface portion 110*a*, and a left upper surface portion 110*c*' and a right upper surface portion 110*c*" extending from the left side surface portion 110*b*' and the right side surface portion 110*b*" so as to be parallel with the lower surface portion 110*a*, thus forming a quadrangular box shape with opposing sides opened.

The cooling tube 120 formed in the evaporator case 110 is connected to the condenser and the compressor described above through a cooling pipe 30 and the refrigerating cycle is formed by the connection. The cooling pipe 30 may be connected to the cooling tube 120 by welding.

In detail, one end (inlet) of the cooling tube 120 is connected to one end 31 of the cooling pipe 30 and the other end (outlet) of the cooling tube 120 is connected to the other end 32 of the cooling pipe 30 to form a circulation loop of the refrigerant R. A low-temperature and low-pressure liquid refrigerant R is introduced through one end of the cooling tube 120, and a gaseous refrigerant R flows out through the other end of the cooling tube 120.

According to the structure, the cooling tube 120 is filled with the refrigerant R for cooling, and the evaporator case 110 and air around the evaporator case 110 are cooled according to circulation of the refrigerant R.

Since the evaporator 100 having the foregoing structure is formed such that the bond type cooling tube 120 is embedded in the evaporator case 110, the evaporator 100 has relatively high heat exchange efficiency, as compared with a structure in which the cooling pipe 30 is installed as a separate component to surround the evaporator case 110. In addition, the storage space for food may be increased due to simplification of the cooling channel structure in which the refrigerant R flows.

The foil heater 130 for defrosting is attached to at least one surface of the evaporator case 110. The foil heater 130 is configured to generate heat when power is applied thereto according to predetermined conditions. The predetermined conditions may be, for example, a case where a temperature sensed by a temperature sensor (not shown) is lower than a set temperature, a case where humidity sensed by a humidity sensor (not shown) is higher than a set humidity, and the like.

Unlike a defrost heater in the form of a metal tube which is applied to an evaporator of the indirect cooling type refrigerator, the foil heater 130 is formed in the form of a soft sheet. Accordingly, the foil heater 130 may be deformed to a shape corresponding to an outer form of the evaporator case 110 so as to be in surface-contact therewith.

Since the inside of the evaporator case 110 forms a storage space for food, the foil heater 130 is preferably attached to an outer surface of the evaporator case 110 so that direct heat transfer to food may be prevented. However, the structure in which the foil heater 130 is attached to an inner surface of the evaporator case 110 is not completely excluded from the present disclosure. In the case of a structure in which direct contact between the foil heater 130 and food is prevented (e.g., in case where a housing forming a storage space for food is separately provided inside the evaporator case 110), the foil heater 130 may also be attached to the inner side of the evaporator case 110.

The foil heater 130 may be attached to the outer surface of the evaporator case 110 to surround the evaporator case 110. The foil heater 130 is attached to cover at least a portion of each of the surface portions (i.e., the lower surface portion 110*a*, the side surface portions 110*b*' and 110*b*", and the upper surface portions 110*c*' and 110*c*") forming the evaporator case 110, and here, the foil heater 130 may be bent to corresponding to the bent portions of the evaporator case 110.

The foil heater 130 may extend and may be bent from at least one point so that a direction in which the foil heater 130 extends is changed. In a portion of the evaporator case 110, which requires more defrosting than in other portions thereof, the foil heater 130 (specifically, a foil portion 131 (See FIG. 6) may be formed to be relatively larger in width or an internal electric heating wire 132 may be disposed more densely.

In addition, the foil heater 130 may be disposed not to overlap the cooling tube 120 to prevent direct heat transfer to the refrigerant R filling the cooling tube 120. For example, the foil heater 130 may extend along the edges of the two case sheets 111 and 112 to surround the cooling tube 120.

Referring to the figure, the foil heater 130 extends from the front side lower surface portion 110*a* of the evaporator case 110 to the left side surface portion 110*b*', to the left side upper surface portion 110*c*', to the rear side left upper surface portion 110*c*', to the left side surface portion 110*b*', and to the lower surface portion 110*a*. Thereafter, the foil heater 130 may extend from the rear side lower surface portion 110*a*, to the right side surface portion 110*b*", to the right side upper surface portion 110*c*", to the front side right side upper surface portion 110*c*", to the right side surface portion 110*b*", and to the lower surface portion 110*a*. Here, one end and the other end of the foil heater 130 may be disposed to face each other.

According to the structure, since the foil heater 130 is disposed on both the front side and the rear side of the evaporator case 110, efficient heat transfer to the entire area of the evaporator case 110 may be achieved.

Figure 4:
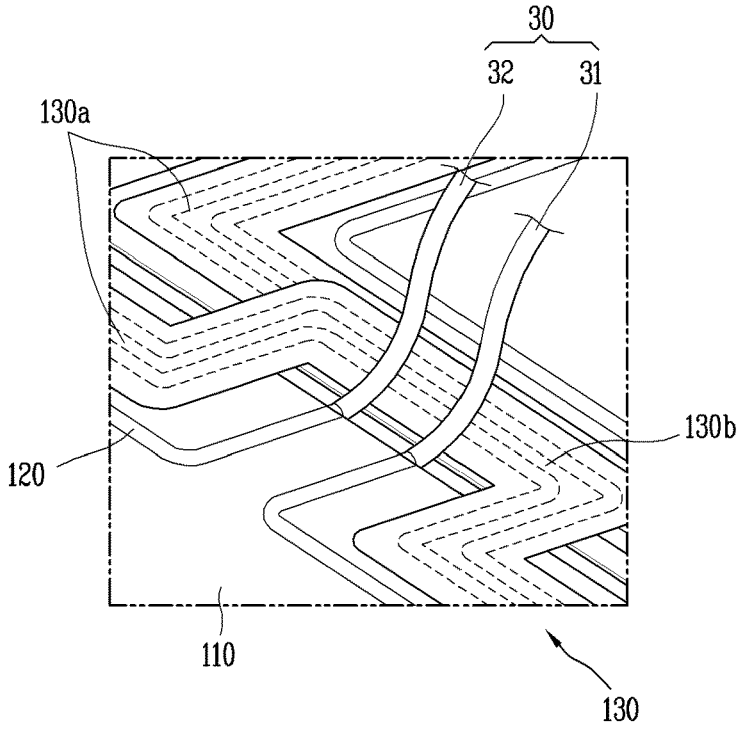
FIG. 4 is an enlarged view of a portion 'A' of FIG. 2.

FIG. 4 is an enlarged view of a portion 'A' of FIG. 2.

As described above, the cooling tube 120 extends to the edges of the two case sheets 111, 112 mutually bonded to form the evaporator case 110. In this figure, the inlet and the outlet of the cooling tube 120 extend to the edge of the left upper surface portion 110*c*' of the evaporator case 110.

The inlet of the cooling tube 120 is connected to one end 31 of the cooling pipe 30 and the outlet of the cooling tube 120 is connected to the other end 32 of the cooling pipe 30*m* forming a circulation loop. A low-temperature and low-pressure liquid refrigerant R flows through one end of the cooling tube 120, and the gaseous refrigerant R flows out through the other end of the cooling tube 120.

When the cooling tube 120 is disposed in this manner, the foil heater 130 may include a first portion 130*a* which is in surface-contact with the evaporator case 110 and surround the cooling tube 120 and a second portion 130*b* extending to an outer side of the evaporator case 110 so that the foil heater 130 may not overlap the cooling tube 120.

The second portion 130*b* is configured to interconnect both sides of the first portion 130*a* spaced apart from each other with a connection portion between the cooling tube 120 and the cooling pipe 30 interposed therebetween, on an outer side of the evaporator case 110. As illustrated, the second portion 130*b* may be disposed to cover the right upper surface portion 110" of the evaporator case 110 and may overlap the first portion 130*a* of the foil heater 130 attached to be in surface-contact with the right side upper surface portion 110*c*".

Hereinafter, a specific structure of the foil heater 130 will be described.

Figure 5:
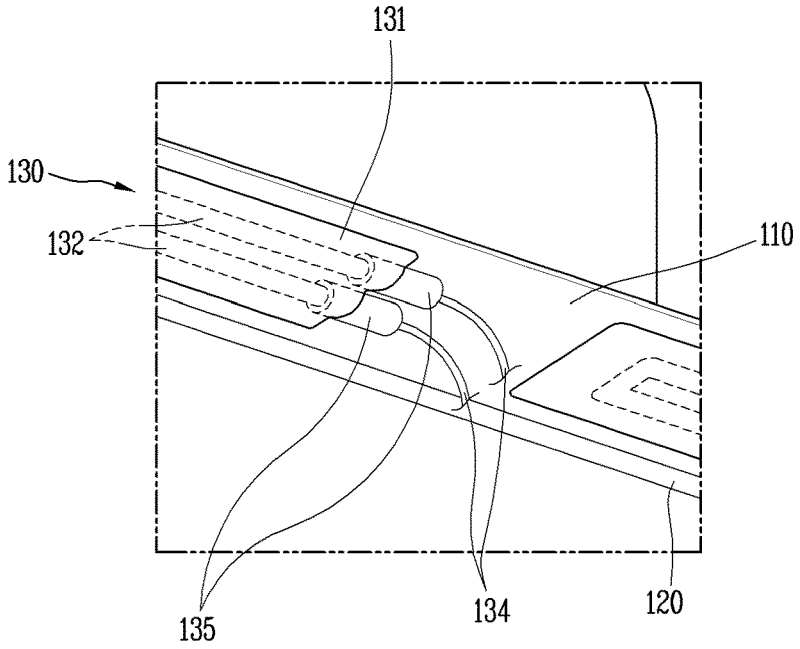
FIG. 5 is an enlarged view of a portion 'B' of FIG. 3.
Figure 6:
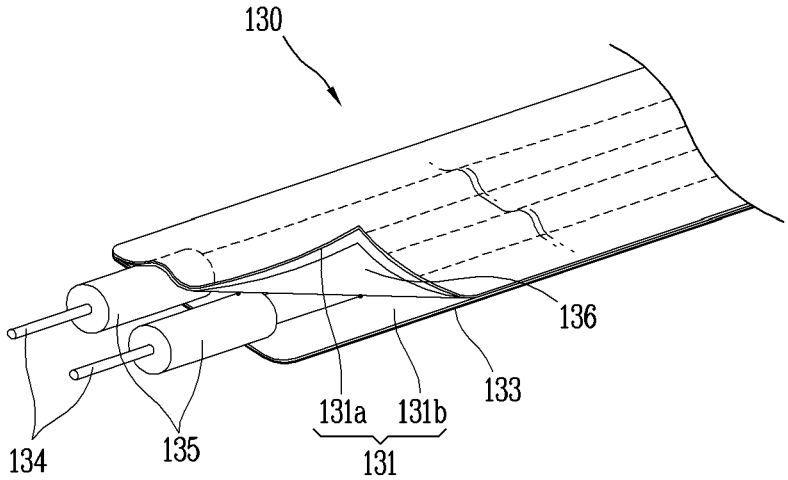
FIG. 6 is a conceptual view illustrating a detailed structure of a foil heater illustrated in FIG. 5.

FIG. 5 is an enlarged view of a portion 13' illustrated in FIG. 3, and FIG. 6 is a conceptual view illustrating a specific structure of the foil heater 130 illustrated in FIG. 5.

Referring to FIGS. 5 and 6 together with FIG. 2, the foil heater 130 includes a foil portion 131, an electric heating wire 132, and a thermally conductive adhesive 133.

The foil portion 131 has a form in which two facing sheets 131*a* and 131*b* are attached to each other. The two sheets 131*a* and 131*b* may be formed of a metal (e.g., aluminum) having ductility and high thermal conductivity. The two sheets 131*a* and 131*b* may be adhered to each other by an adhesive 136.

Since the foil portion 131 is formed as a sheet and is in surface-contact with the evaporator case 110, the amount of heat generated by the electric heating wire 132 and transmitted to the evaporator case 110 may be increased. That is, efficiency of heat transfer to the evaporator case 110 may be improved and energy loss of the electric heating wire 132 may be reduced.

The electric heating wire 132 is interposed between the two facing sheets 131*a* and 131*b* of the foil portion 131 and generates heat when power is applied thereto. For example, the electric heating wire 132 may be configured such that a core portion formed of an insulating material is wound around with a heating wire portion formed to generate when power is applied, which is covered with a coating portion formed of a heat-resistant material.

The electric heating wire 132 may extend along the covering portion 131. In this embodiment, it is illustrated that the electric heating wire 132 extends from one end of the foil portion 131 toward the other end thereof is bent at the other end of the foil portion 131, and extends in the opposite direction toward the other end. According to the above arrangement, both ends of the electric heating wire 132 are positioned at one end of the foil portion 131.

However, the arrangement of the electric heating wires 132 is not limited thereto. The electric heating wire 132 may extend from one end of the foil portion 131 to the other end so that both end portions of the electric heating wire 132 are positioned at both ends of the foil portion 131. In addition, the electric heating wire 132 may be bent a plurality of times in the foil portion 131, regardless of an extending direction of the foil portion 131.

A thermally conductive adhesive 133 is provided on one surface of the foil portion 131 and attached to at least one surface of the evaporator case 110.

A lead wire 134 is connected to the electric heating wire 132. The lead wire 134 is electrically connected to a power supply unit (not shown) controlled in driving by a controller. A heat-resistant tube 135 may be formed at a connection portion between the electric heating wire 132 and the lead wire 134 and surround the connection portion.

The lead wire 134 is exposed to the outside of the foil portion 131 for electrical connection with the power supply unit. Thus, there is a possibility that the lead wire 134 is in contact with moisture including defrosting water. In consideration of this, a protective tube (not shown) may be formed to cover the lead wire 134. The protection tube may be formed of a heat-resistant synthetic resin material (e.g., PVC, or the like).

In addition, in order to prevent penetration of moisture to the end of the foil portion 131 from which the lead wire 134 extends, a cover member 140 (See FIG. 3) may be disposed to cover the end of the coil portion 131. The cover member 140 may be installed on the evaporator case 110 by a fastening member or an adhesive.

As described above, the foil heater 130 is attached to at least one surface of the evaporator case 110 so as to be in surface contact therewith and is driven (turned on/off) according to predetermined conditions to generate heat. Heat generated by the foil heater 130 is transferred to the evaporator case 110 to melt frost deposited on the evaporator 100 to remove the same. As described above, according to the present disclosure, since a defrost time is reduced as compared with existing natural defrosting, freshness of food may be maintained and cooling efficiency, which is reduced due to frost, is increased to reduce power consumption.

According to the present disclosure, the structure of the present disclosure may be realized by attaching the foil heater 130 to the existing roll-bond type evaporator case. In addition, maintenance of the foil heater 130 may be facilitated in terms of the structure in which the foil heater 130 is attached to the evaporator case 110.

Meanwhile, in terms of the structure in which the foil heater 130 is attached to the evaporator 110, if frost is deposited on the foil heater 130, the foil heater 130 may be separated from the evaporator case 110 due to the weight, affecting defrost reliability. Hereinafter, a structure capable of solving the problem related to defrost reliability by preventing the foil heater 130 from being completely separated from the evaporator case 110 will be described.

Figure 7:
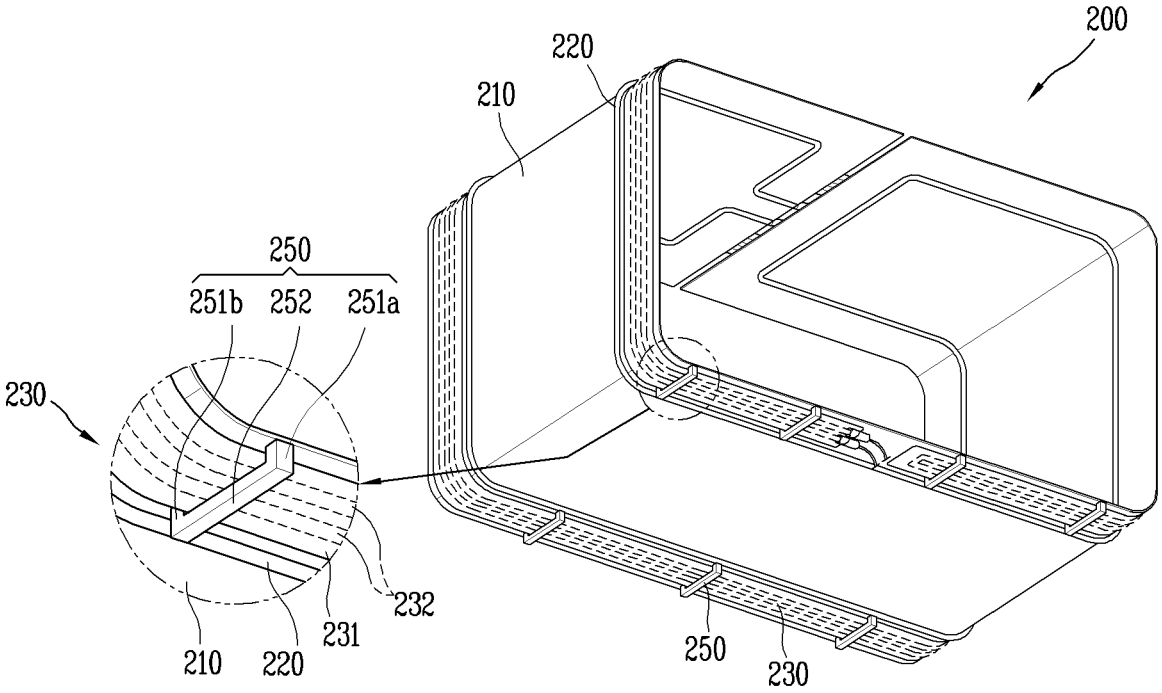
FIG. 7 is a conceptual view illustrating a second embodiment of an evaporator applied to the refrigerator of FIG. 1.

FIG. 7 is a conceptual view illustrating a second embodiment of an evaporator 200 applied to the refrigerator 1 of FIG. 1.

Referring to FIG. 7, an evaporator case 210 includes a release preventing member 250 disposed to cover an outer side of the foil heater 230 to prevent the foil heater 230 from being separated. Considering that the foil heater 230 is mainly released (or separated) from the evaporator 200 due to frost deposited on the evaporator 200 and, due to this, the foil heater 230 attached to a lower surface portion of the evaporator case 210 is largely released, the release preventing member 250 may be provided on the lower surface portion of the evaporator case 210.

The release preventing member includes a first protrusion 251*a*, a second protrusion 251*b*, and a connection portion 252 and supports the foil heater 230. The release preventing member 250 is formed of a metal material and may be fixed to the evaporator case 210 by welding. The release preventing member 250 may be provided in plurality, and the plurality of the release preventing members 250 may be spaced apart from each other by a predetermined distance.

The first and second protrusions 251*a* and 251*b* protrude from both sides of the foil heater 230, and the connection portion 252 connects the first and second protrusions 251*a* and 251*b* to cover an outer side of the foil heater 230.

According to the above-described configuration, the release preventing member 250 has a 'C'-shape and surrounds the foil heater 230 together with the evaporator case 210. Accordingly, although the foil heater 230 is separated from the evaporator case 210, the foil heater 230 may be supported by the connection portion 252 and placed adjacent to the evaporator case 210. Therefore, deterioration of defrost function due to separation of the foil heater 230 may be minimized.

Here, as the connection portion 252 of the release preventing member 250 is disposed to be closer to the evaporator case 210, a space between the separated foil heater 230 and the evaporator case 210 is reduced to make defrost efficiency to appear to be similar to that before the foil heater 230 is separated. In case where the connection portion is configured to press the foil heater 230, separation of the foil heater 230 may be prevented.

Hereinafter, another example of a release preventing member 360 will be described.

Figure 8:
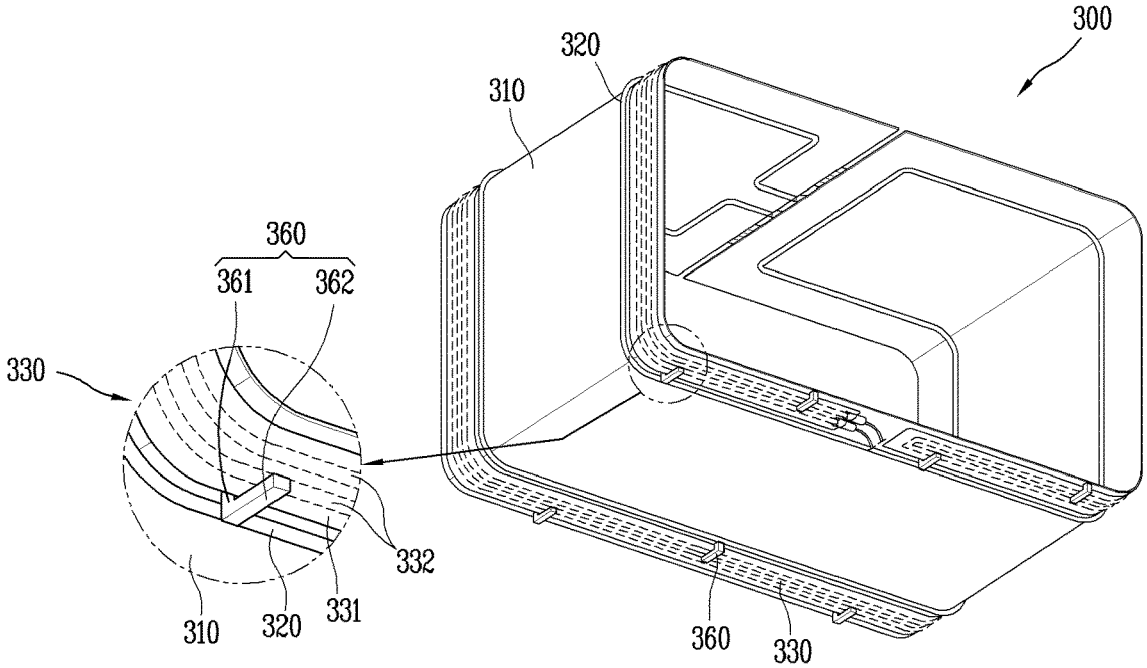
FIG. 8 is a conceptual view illustrating a third embodiment of an evaporator applied to the refrigerator of FIG. 1.

FIG. 8 is a conceptual view illustrating a third embodiment of an evaporator 300 applied to the refrigerator 1 of FIG. 1.

Referring to FIG. 8, the release preventing member 360 may be provided on a lower surface portion of an evaporator case 310, like the release preventing member 250 of the previous example.

The release preventing member 360 includes a protrusion 361 protruding from one side of the foil heater 330 and an extending portion 362 bent from the protrusion 361 to extend to cover an outer side of the foil heater 330. The release preventing member 360 is formed of a metal material and may be fixed to the evaporator case 310 by welding.

According to the above-described configuration, the release preventing member 360 has an 'L'-shape and supports the foil heater 330. The release preventing member 360 may be provided in plurality and the plurality of release preventing members 360 may be spaced apart from each other by a predetermined distance and may be alternately disposed on one side and the other side of the foil heater 330.

Although the foil heater 330 may be separated from the evaporator case 310, the foil heater 330 may be supported by the extending portion 362 and placed to be adjacent to the evaporator case 310. Therefore, deterioration of the defrost function due to separation of the foil heater 330 may be minimized.

It is needless to say that the distances between the extending portion 362 of the release preventing member 360 and the evaporator case 310 may be appropriately adjusted as in the foregoing example.

Figure 9:
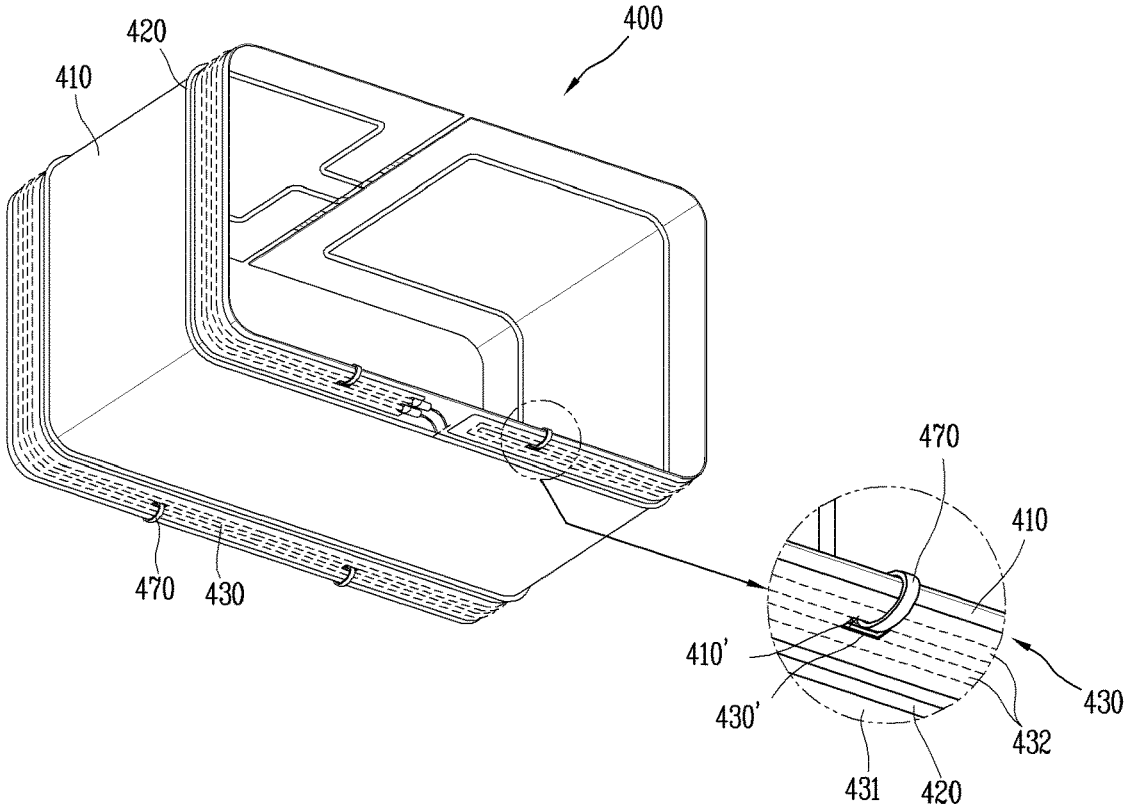
FIG. 9 is a conceptual view illustrating a fourth embodiment of an evaporator applied to the refrigerator of FIG. 1.

FIG. 9 is a conceptual view illustrating a fourth embodiment of an evaporator 400 applied to the refrigerator 1 of FIG. 1.

Referring to FIG. 9, an evaporator case 410 includes a fixing member 470 for binding a foil heater 430 to an evaporator case 410 to fix it. The fixing member 470 may be provided on a lower surface portion of the evaporator case 410, like the release preventing members 250 and 360 of the previous example.

A hole 410' may be formed in the evaporator case 410 and a through hole 430' corresponding to the hole 410' may be formed in the foil heater 430 to bind the foil heater 430 to the evaporator case 410. Here, the through hole 430' is formed in a foil portion 431 in which the electric heating wire 432 is not disposed.

The fixing member 470 passes through the holes 410' and the through holes 430', and then is wound and bound to the outside of the evaporator case 410. Thus, complete separation of the foil heater 430 may be prevented. As the fixing member 470, a cable tie formed of a synthetic resin, which is mainly used for organizing lines, may be used.

Figure 10:
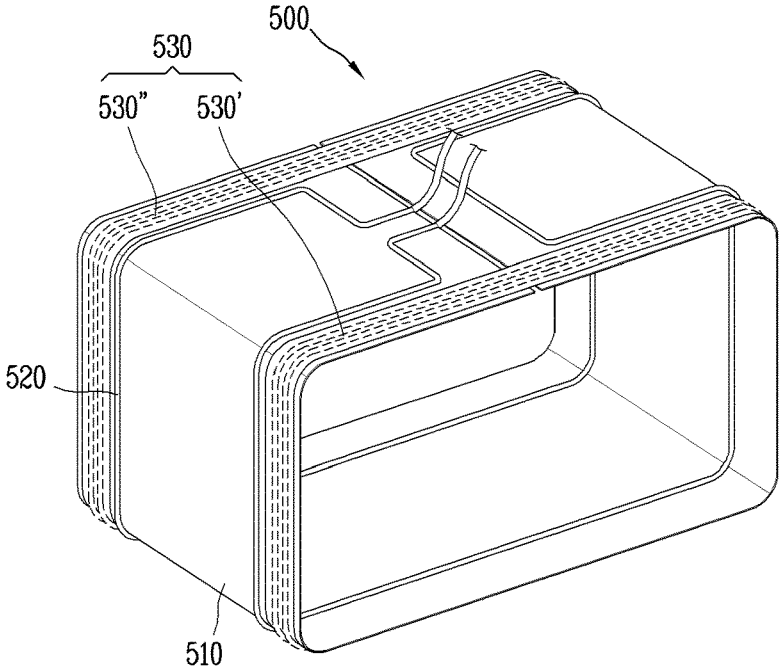
FIGS. 10 and 11 are conceptual views of a fifth embodiment of an evaporator applied to the refrigerator of FIG. 1, viewed from different directions.
Figure 11:
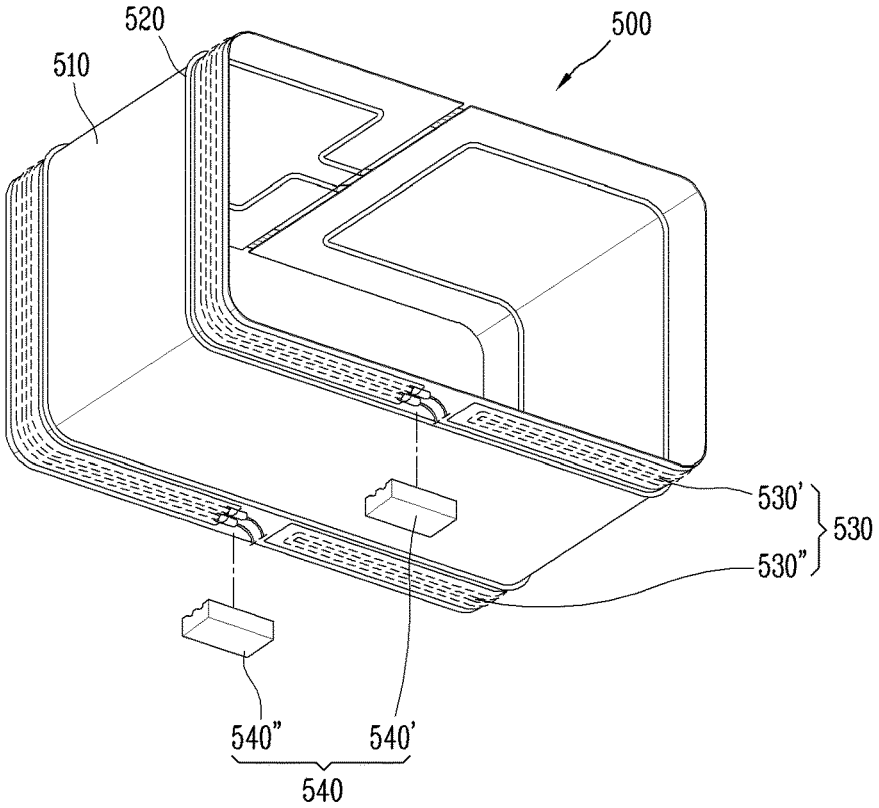

FIGS. 10 and 11 are conceptual views illustrating a fifth embodiment of an evaporator 500 applied to the refrigerator 1 of FIG. 1, which are viewed in different directions.

Referring to FIGS. 10 and 11, a foil heater 530 may be provided in plurality. In this embodiment, it is illustrated that the foil heater 530 includes a first foil heater 530' and a second foil heater 530.

First and second foil heaters 530' and 530" are disposed not to overlap each other and are connected to a power supply unit (not shown). Cover members 540' and 540" covering the ends of the first and second foil heaters 530' and 530" to prevent penetration of moisture may be mounted on the evaporator case 510.

The first and second foil heaters 530' and 530" may be disposed on both sides of the cooling tube 520 interposed therebetween. In this embodiment, the first foil heater 530' extends from a lower surface portion of a front side of the evaporator case 510 to a left side upper surface portion through a left side surface portion, and subsequently extends to an adjacent right side upper surface portion and is returned to the lower surface portion through a right side surface portion. Similarly, the second foil heater 530" is disposed to extend from the lower surface portion of the rear side to the left side surface portion through the left side surface portion and subsequently extend to the adjacent right side upper surface portion and is returned to the lower surface portion through the right side surface portion.

According to the above structure, since the first and second foil heaters 530' and 530" are formed to surround the front side and the rear side of the evaporator case 510, respectively, heat is efficiently transferred to the entire region of the evaporator case 110.

In addition, the shape of the first and second foil heaters 530' and 530" may be simplified as compared with the first embodiment in which the single foil heater 130 is provided and has a complicated shape.

Unlike the first embodiment in which the second portion **130*b* extends to the outer side of the evaporator case 110 to avoid overlapping with the cooling tube 120, the first and second foil heaters 530' and 530" are formed as only parts in surface-contact with the evaporator case 110**, obtaining improved defrosting efficiency.

What is claimed is:

1. An evaporator comprising:

an evaporator case having a bent plate shape, the evaporator case defining two open sides that face each other and a storage space that is configured to receive food between the two open sides;

a cooling tube that has a predetermined pattern, that is disposed in the evaporator case, and that is filled with refrigerant for cooling; and a foil heater that is attached to and in surface-contact with an outer surface of the evaporator case, that extends along edges of the two open sides, and that surrounds the cooling tube, the foil heater being configured to generate heat based on receiving power for defrosting the evaporator case, wherein the evaporator case is bent to define surfaces of a quadrangular box shape having a lower surface, side surfaces that define the two open sides, respectively, and an upper surface that is disposed vertically above the lower surface, wherein the upper surface of the evaporator case has a gap that is defined at opposing ends of the evaporator case, the gap extending from one of the two open sides to the other of the two open sides, wherein the foil heater extends over the gap defined in the upper surface of the evaporator case, wherein the foil heater includes:

a foil including two facing sheets that are attached to each other and that are made of metal having ductility, an electric heating wire that is interposed between the two facing sheets and that is in contact with the two facing sheets, the electric heating wire being configured to generate heat based on receiving the power, and a thermally conductive adhesive that is provided on an outer surface of the foil and that attaches the foil to the outer surface of the evaporator case, and wherein the foil heater is spaced apart from the cooling tube and arranged on the outer surface of the evaporator case without overlapping with the cooling tube.

2. The evaporator of claim 1, wherein the foil heater surrounds the outer surface of the evaporator case.

3. The evaporator of claim 1, wherein:

the evaporator case comprises two coupled case sheets that are bent to define surfaces corresponding to the quadrangular box shape, and the foil heater is attached to and in surface-contact with at least a portion of each of the lower surface, the side surfaces, and the upper surface to surround the evaporator case.

4. The evaporator of claim 1, wherein:

the foil heater further includes a lead wire connected to the electric heating wire and extending to the outside of the foil, and the lead wire exposed to the outside of the foil is covered with a protective tube.

5. The evaporator of claim 4, further comprising:

a cover disposed to cover an end of the foil to prevent penetration of moisture to the end of the foil from which the lead wire extends.

6. The evaporator of claim 1, wherein the evaporator case includes a release preventing protrusion disposed to cover an outer side of the foil heater to prevent release of the foil heater.

7. The evaporator of claim 6, wherein:

the evaporator case comprises two coupled case sheets that are bent to correspond to surfaces of the quadrangular box shape, and the release preventing protrusion is provided on the lower surface.

8. The evaporator of claim 6, wherein the release preventing protrusion includes:

first and second protrusions respectively protruding from sides of the foil heater; and a connection that connects between the first and second protrusions to cover the outer side of the foil heater.

9. The evaporator of claim 6, wherein the release preventing protrusion includes:

a protrusion protruding from one side of the foil heater; and an extending protrusion that is bent from the protrusion and extends to cover the outer side of the foil heater.

10. The evaporator of claim 1, wherein:

a hole is formed in the evaporator case, a through hole corresponding to the hole is formed in the foil heater, and the foil heater is fixed by a fixing member which is wound on an outer side of the evaporator case through the hole and the through hole so as to be bound.

11. The evaporator of claim 1, wherein the opposing ends comprise a first end and a second end that face each other, and wherein at least a portion of the foil heater extends over the gap from the first end of the evaporator case to the second end of the evaporator case, at least the portion of the foil heater overlapping with another portion of the foil heater disposed at the second end of the evaporator case.

12. The evaporator of claim 1, wherein the cooling tube includes an inlet and an outlet that are defined at one of the opposing ends of the evaporator case and that face the other of the opposing ends of the evaporator case.

13. The evaporator of claim 1, wherein the two open sides are spaced apart from each other in a first direction, wherein the foil heater has an outer side edge and an inner side edge that are spaced apart from each other in the first direction and that extend in a second direction different from the first direction, the outer side edge facing one of the edges of the two open sides, and wherein a width of the foil heater in the first direction is greater than a distance between the one of the edges of the two open sides and the outer side edge of the foil heater in the first direction.

14. The evaporator of claim 1, wherein the foil heater further includes an adhesive that attaches inner surfaces of the two facing sheets to each other, and wherein the thermally conductive adhesive is provided on an outer surface of one of the two facing sheets.

15. An evaporator comprising:

an evaporator case comprising two case sheets that are coupled and bent to define surfaces corresponding to a box shape, the evaporator having a lower surface, a first pair of side surfaces that define two open sides facing each other, an upper surface that is disposed vertically above the lower surface, and a second pair of side surfaces that connect the upper surface to the lower surface;

a cooling tube defined by an empty space between the two case sheets, the cooling tube defining a cooling flow channel configured to carry refrigerant; and a foil heater that is attached to and in surface-contact with at least a portion of each of the lower surface, the second pair of side surfaces, and the upper surface to surround the evaporator case, that extends along edges of the two open sides, and that surrounds the cooling tube, the foil heater being configured to generate heat based on receiving power for defrosting the evaporator case, wherein the upper surface of the evaporator has a gap that is defined at opposing ends of the evaporator case, the gap extending from one of the two open sides to the other of the two open sides, wherein the foil heater extends over the gap defined in the upper surface of the evaporator case, wherein the foil heater includes:

a foil including two facing sheets that are attached to each other and that are made of metal having ductility, an electric heating wire that is interposed between the two facing sheets and that is in contact with the two facing sheets, the electric heating wire being configured to generate heat based on receiving the power, and a thermally conductive adhesive that is provided on one surface of the foil and that adheres the foil to an outer surface of the evaporator case, and wherein the foil heater is spaced apart from the cooling tube and arranged on the outer surface of the evaporator case without overlapping with the cooling tube.

16. The evaporator of claim 15, wherein the evaporator case includes a release preventing protrusion that covers an outer side of the foil heater is configured to restrict release of the foil heater.

17. The evaporator of claim 15, wherein:

the foil heater further includes a lead wire connected to the electric heating wire and extending to the outside of the foil, and the lead wire exposed to the outside of the foil is covered with a protective tube.

18. The evaporator of claim 17, further comprising:

a cover disposed to cover an end of the foil to prevent penetration of moisture to the end of the foil from which the lead wire extends.

* * * * *